United States Patent [19]

Donohie

[11] Patent Number: 4,749,086

[45] Date of Patent: Jun. 7, 1988

[54] CARTON AND BLANK FOR PACKAGING ICE CREAM OR THE LIKE

[75] Inventor: Paul J. Donohie, Pittsford, N.Y.

[73] Assignee: Rolph-Clark-Stone Packaging Corporation, Newport News, Va.

[21] Appl. No.: 13,685

[22] Filed: Feb. 11, 1987

[51] Int. Cl.[4] ..... B65D 5/54

[52] U.S. Cl. ..... 206/611; 206/626; 229/905

[58] Field of Search ..... 206/611, 626, 629, 631, 206/624; 229/132, 172, 905, 44 R

[56] References Cited

U.S. PATENT DOCUMENTS 4,555,027 11/1985 Froom ..... 206/626

4,669,614 6/1987 Froom ..... 206/611

*Primary Examiner*—Willis Little

*Attorney, Agent, or Firm*—Shesinger, Arkwright & Garvey

[57] ABSTRACT

The present invention pertains to a design for a carton blank for significantly enhancing the seal of a carton for packaging semi-liquids such as ice cream or the like without compromising the adaptability of the carton blank to mechanical folding devices. The carton blank includes front, bottom rear, and cover panels. A closure flap is hingedly connected to a top edge of the cover panel. The closure flap includes a tear strip for enabling a consumer to readily gain access to the contents of the carton. An end flap extends from each edge of the cover, rear, bottom and front panels. A cover or glue tab extends from each edge of the closure flap. A membrane extends from each of the front panel end flaps and the front panel for forming a substantially continuous lip about a potion of the outer periphery of the carton. The front panel membrane includes notches or recess at each end for receiving the corresponding ends of the front panel end flap membranes.

28 Claims, 4 Drawing Sheets

CARTON AND BLANK FOR PACKAGING ICE CREAM OR THE LIKE

FIELD OF THE INVENTION

This invention relates to a blank and a carton for packaging semi-liquids such as ice cream or the like. Specifically, a design for a carton blank that permits the blank to be readily erected by mechanical means while also improving the overall seal of the carton.

BACKGROUND OF THE INVENTION

Numerous designs for carton blanks have been proposed for enhancing the seal of the carton blank when fully erected, the adaptability of the carton blank to mechanical folding devices, and the minimization of scrap stock material from which the blanks are formed. Additionally, several carton blank designs, directed at the resealing aspect of the carton after the consumer has initially opened the same, have been suggested. The following U.S. Pat. Nos. are indicative of the previously known designs for carton blanks: 3,097,313; 3,194,479; 3,206,103; 3,281,055; 4,833,165; 4,046,313; 4,239,115 and 4,555,027. The carton blanks suggested by the aforementioned patents have focused merely on one or two of the desirable features of a carton blank. Prior to the present invention, the packaging industry has been unable to develop a carton blank, superior in design in every desirable feature, for use in packaging semi-liquids such as ice cream or the like.

OBJECTS AND SUMMARY OF THE INVENTION

Accordingly, it is an object of this invention to provide an improved blank and carton, for packaging semi-liquids such as ice cream or the like.

Another object of the invention is to provide a carton blank that can be readily erected by mechanical devices by minimizing either intermittent delays caused by jams in the assembly process or waste discard of partially and incorrectly erected carton blanks and the contents contained therein.

A further object of the invention is to provide a carton that can be easily resealed after the initial opening of the same by the consumer.

Yet another object of the invention is to provide a carton, for packaging semi-liquids, with a superior seal.

Another object of the invention is to provide a carton blank that can be manufactured in multiples, from web or sheet stock, with reduced waste or scrap produced during the blanking operation.

In summary, the present invention discloses a novel design for a carton blank including membranes extending from the front panel end flaps and the front panel for forming a substantially continuous lip about a portion of the outer periphery of the carton.

DETAILED DESCRIPTION OF THE INVENTION

FIG. 1

Figure 1:
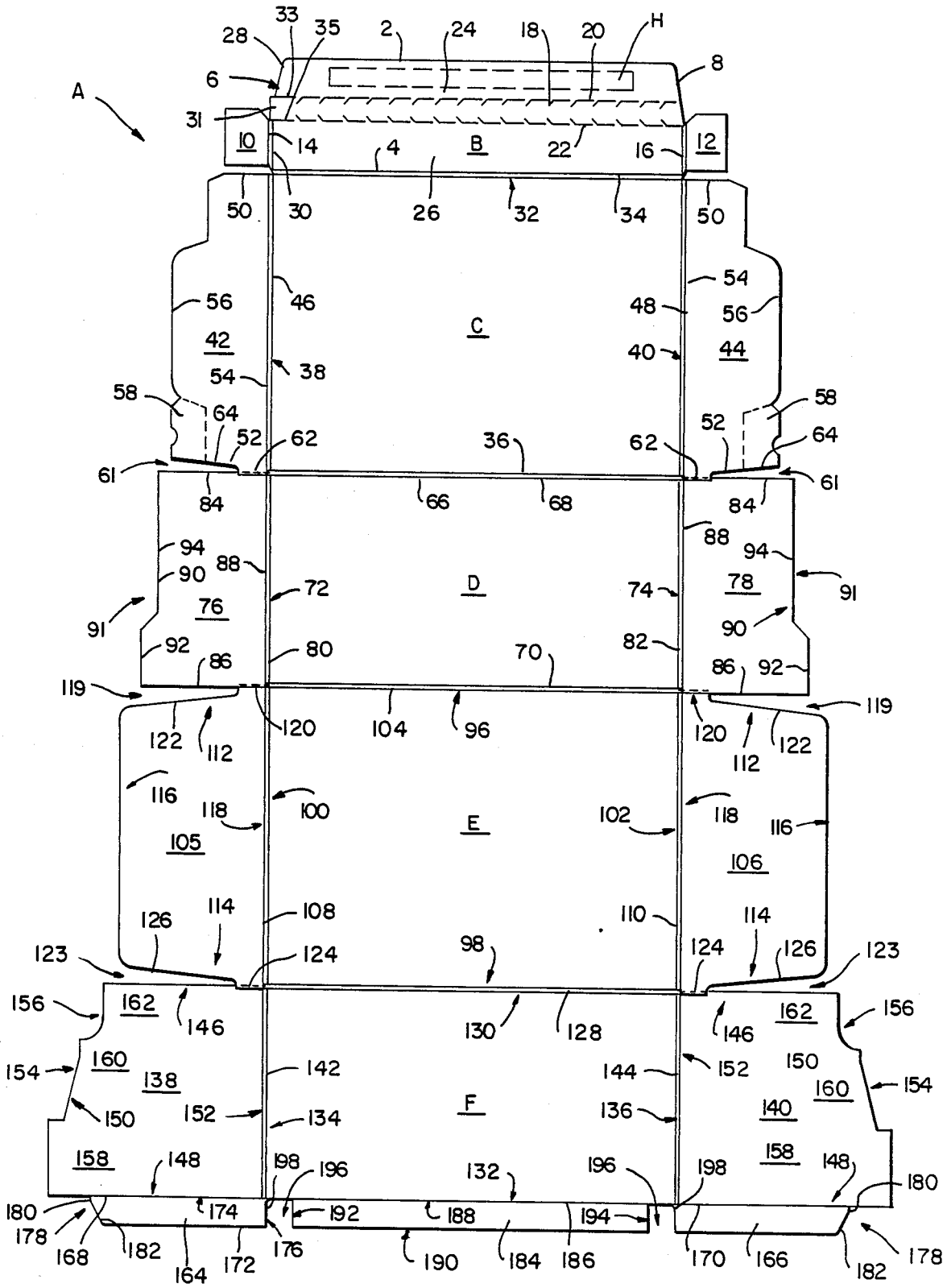
FIG. 1 is a plan view of the inner surface of a flat carton blank formed in accordance with the present invention.
Figure 8:
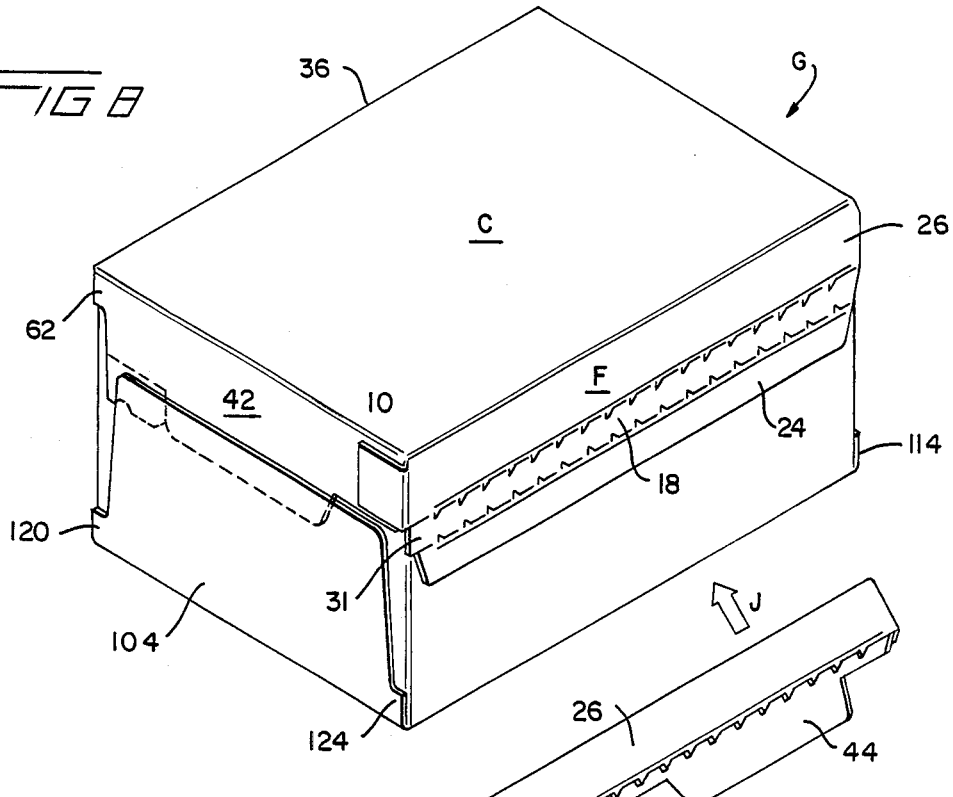
FIG. 8 is a perspective view of the sealed carton.

The specific nomenclature assigned to each component and subscomponent comprising carton A refers to its orientation when carton blank A is fully erected and as viewed in the direction of arrow J in FIG. 8. Referring to FIG. 1, a carton blank A is comprised of a closure flap B, a cover panel C, a rear panel D, a bottom panel E, and a front panel F. Closure flap B includes a top edge 2, a bottom edge 4, a left edge 6 and a right edge 8. Left and right cover or glue tabs 10 and 12 are hingedly connected to left and right edges 6 and 8 respectively. Vertically extending hinge lines 14 and 16 are formed therebetween. A tear strip 18 is formed in closure flap B for detaching the cover panel C from the front panel F. Tear strip 18 includes spaced weakness lines 20 and 22. Weakness lines 20 and 22 subdivide closure flap B into a glue panel or segment 24 and a skirt or resealable flap 26. The glue segment 24 includes an end 28 that extends inwardly from end 30 of closure flap B exposing tear tab 31. Tear tab 31 is formed in tear strip 18 by cut-lines 33 and 35. This configuration of tear strip 18 enables the consumer to readily detach the cover panel C from front panel F to gain access to the contents of the carton. It will be appreciated by one of ordinary skill in the art that various other types of tear tabs may be used.

Cover panel C is hingedly connected at its front edge 32 to top edge 2 of closure flap B forming horizontally extending hinge line 34. Cover panel C further includes rear edge 36, left edge 38, and right edge 40. End flaps 42 and 44 are hingedly connected to left and right edges 38 and 40 of cover panel C respectively forming vertically extending hinge lines 46 and 48.

Cover panel end flaps 42 and 44 each include front, rear, top, and bottom edges 50, 52, 54 and 56. Detachably connected to bottom edges 56 are tear-away tabs 58. The function of tear-away tabs 58 and of the specific configuration of bottom edges 56 of cover panel end flaps 42 and 44 are fully explained in U.S. Pat. No. 4,555,027 the entire disclosure of which is herein incorporated by reference. Rear edges 52 include cut-outs 61 forming first and second portions 62 and 64.

Rear panel D is hingedly connected at its top edge 66 to rear edge 36 to cover panel C forming horizontally extending hinge line 68 therebetween. Additionally, rear panel D includes bottom left and right edges 70, 72 and 74. Rear panel end flaps 76 and 78 are hingedly connected to left and right edges 72 and 74 respectively forming vertically extending hinge lines 80 and 82.

Rear panel end flaps 76 and 78 are defined by top, bottom, rear, and front edges 84, 86, 88 and 90. Front edges 90 of rear panel D each have a cut-out 91 forming first and second portions 92 and 94. Top edge 84 extends substantially parallel to and is substantially aligned with the center-line of hinge line 68. First portions 92 extend outwardly from and are parallel to second portions 94.

Bottom panel E is defined by rear, front, left and right edges 96, 98, 100 and 102. Bottom panel E is hingedly connected at its rear edge 96 to bottom edge 70 of rear panel D forming horizontally extending hinge line 104.

Left and right bottom panel end flaps 105 and 106 are hingedly connected to left and right edges 100 and 102 of bottom panel E respectively. Vertically extending hinge lines 108 and 110 are formed between left and right bottom panel end flaps 105 and 106 and bottom panel E. Left and right bottom panel end flaps 105 and 106 include rear, front, top and bottom edges 112, 114, 116 and 118. Rear edges 112 of left and right end flaps 105 and 106 have cut-outs 119 forming first and second portions 120 and 122. First portions 120 extend substantially parallel to hinge line 104 and, are aligned with bottom edge 70 of rear panel D. Thus, first portions 120 overlap corresponding rear panel end flaps 76 and 78. Similarly, front edges 114 of bottom panel end flaps 105 and 106 include cut-outs 123 forming first and second portions 124 and 126. First portions 124 extend substantially parallel to horizontally oriented hinge line 128, intermediate front panel F and bottom panel E.

Front panel F is hingedly connected at its bottom edge 130 to the front edge 98 of bottom panel E. Front panel F is further defined by top, left and right edges 132, 134 and 136. Left and right front panel end flaps 138 and 140 are hingedly connected to left and right edges 134 and 136 of front panel F forming therebetween vertically extending hinge lines 142 and 144.

Front panel end flaps 138 and 140 each include bottom, top, rear and front edges 146, 148, 150 and 152. First portions 124 of bottom panel end flaps 104 and 106 are substantially aligned with bottom edge 130 and, therefore, overlap the corresponding front panel end flaps 138 and 140. Rear edges 150 of bottom panel end flaps 138 and 140 include first and second cut-outs 154 and 156 formed therein subdividing the front panel end flaps into a top section 158, mid-section 160, and bottom section 162.

Front panel end flaps membranes 164 and 166 are hingedly connected to top edges 148 of front panel end flaps 138 and 140 respectively forming horizontally extending hinge lines 168 and 170 therebetween. End flap membranes 164 and 166 are defined by outer, inner, front and rear edges 172, 174, 176 and 178. Front edges 176 of end flap membranes 164 and 166 are substantially aligned with corresponding hinge lines 142 and 144. Rear edges 178 are formed inwardly of the outer most edge of top section 158 of front panel end flaps 138 and 140. Rear edges 178 of end flap membranes 164 and 166 include first and second portions 180 and 182. First portions 180 extends perpendicular to top edges 148 of corresponding front panel end flaps 138 and 140. Second portions 182 form angle with first portions 180 less than 180°.

Front panel membrane 184 is hingedly connected to top edge 132 of front panel F forming therebetween a horizontally extending hinge line 186. Front panel membrane 184 includes front, rear, left and right edges 188, 190, 192 and 194. Front edge 188 of front panel membrane 184 is substantially aligned with outer edges 172 of end flap membranes 164 and 166. Similarly, rear edge 190 of front panel membrane 184 is substantially aligned with inner edges 174 of end flap membranes 164 and 166. Left and right edges 192 and 194 are positioned inwardly from the corresponding hinge lines 142 and 144 forming notches or recesses 196 intermediate front panel membrane 184 and end flap membranes 164 and 166. Recesses 196 are substantially rectangular in shape and extend along top edge 132 of front panel F a distance substantially equal to the distance the inner edges 174 of end flap membranes 164 and 166 extend from the top edges 148 of front panel end flap membranes 138 and 140. A radius 198 is formed in the corner of each recess 196 adjacent the corresponding hinge lines 142 and 144.

Vertically extending hinge lines 14, 16, 46, 48, 80, 82, 108, 110, 142 and 144 extend substantially parallel to each other. Hinge lines 14 and 16 are positioned outwardly of hinge lines 46, 48, 80, 82, 108, 110, 142 and 144. This particular configuration of the vertically extending hinge lines permits the glue or cover tabs 10 and 12 to overlie the cover panel end flaps 42 and 44. The horizontally extending hinge lines 34, 66, 104, 128 and 186 are substantially parallel to each other and, or course, substantially perpendicular to the aforementioned vertically extending hinge lines.

Figure 3:
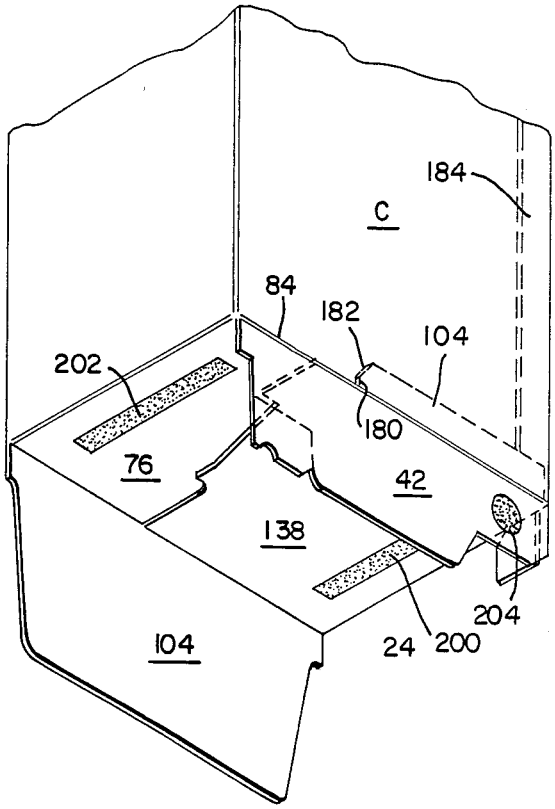
FIG. 3 is a fragmentary perspective view of the carton blank with the left front and rear panel end flaps folded inwardly.

An adhesive H in the form of a strip or other well known forms is applied to glue segment 24. Adhesive strips 200 are applied to the outer faces of front panel end flaps 138 and 140 adjacent and extending parallel to corresponding hinge lines 42 and 48, best seen in FIG. 3. (Note only end flap 138 is shown) In a similar manner, adhesive strips 202 are applied to rear panel end flaps 76 and 78, as best seen in FIG. 3. (Note only end flap 76 is shown) Finally, an adhesive 204 in patch or spot form is applied to cover panel end flaps 42 and 44 adjacent glue or cover tabs 10 and 12 as best seen in FIG. 3.

Figure 5:
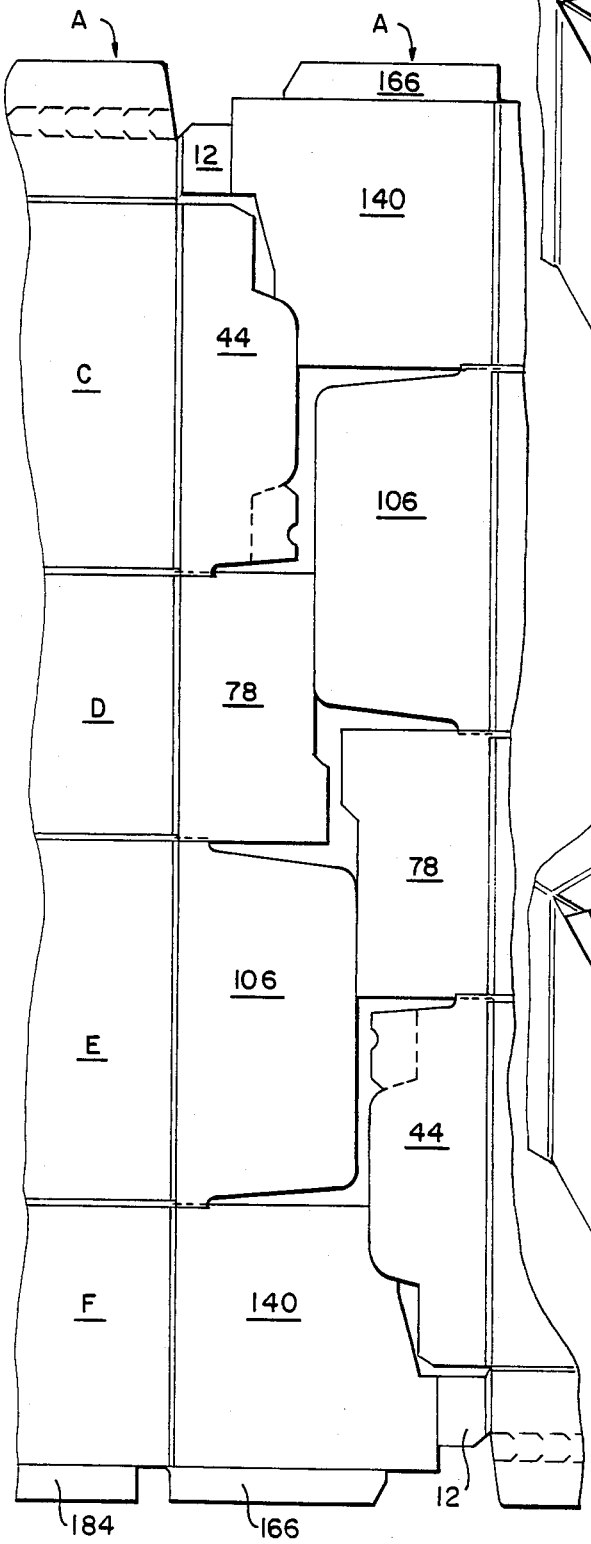
FIG. 5 is a fragmentary plan view of a pair of carton blanks illustrating their orientation during the blanking operation.

Referring to FIG. 5, a pair of blanks A are depicted as oriented during the blanking operation. As is evident from FIG. 5, the end flaps have been designed to minimize the amount of scrap stock produced.

CARTON ASSEMBLY

FIGS. 1–4 AND 6–8

Figure 2:
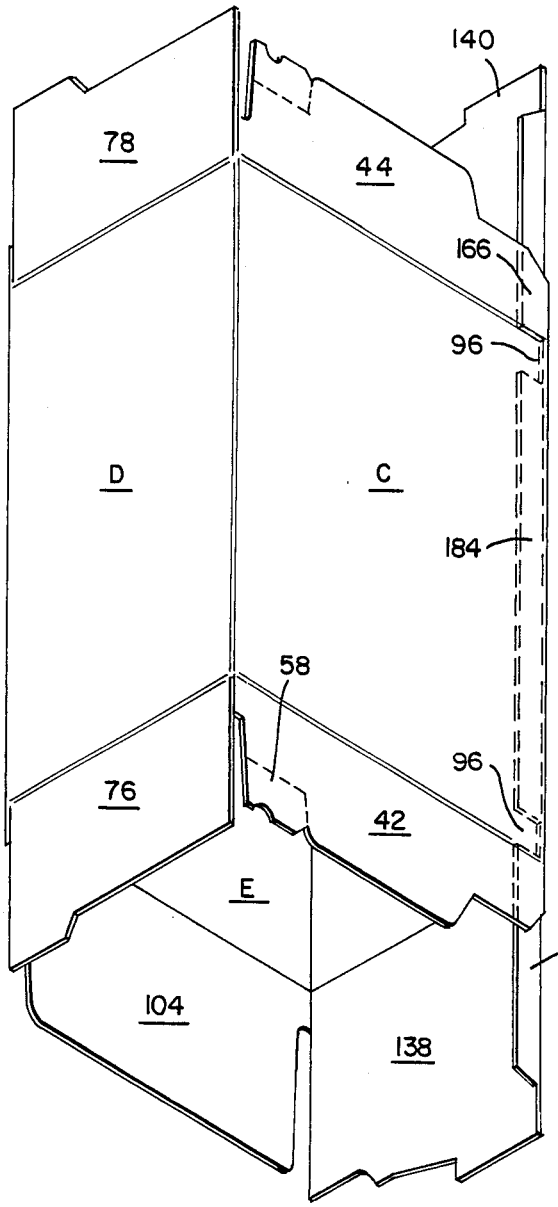
FIG. 2 is a perspective view of the carton blank with the body panels fully erected and the end flaps fully extended.
Figure 4:
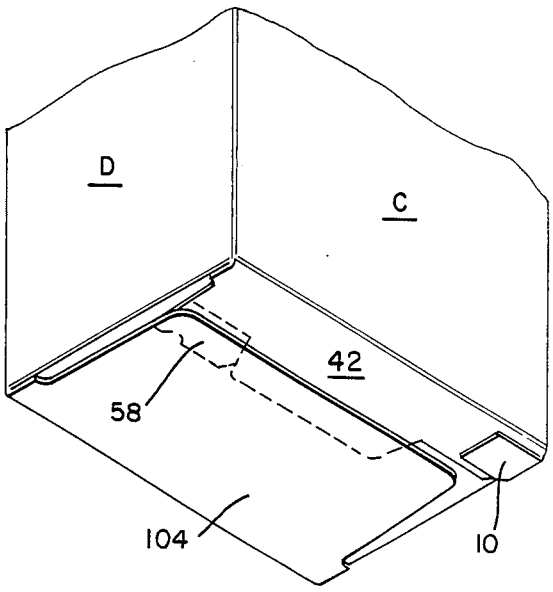
FIG. 4 is a fragmentary perspective view of the carton blank with the end completely sealed.

The specific steps taken to assemble the blank A will now be described. The initial step taken to assemble the blank A includes folding front panel F about hinge line 130 such that front panel F lies flat on bottom panel E. Subsequently, the closure flap B and the cover panel C are folded about hinge line 36 such that closure flap B lies flat on front panel F and cover panel C overlies rear panel D and a portion of bottom panel E. A force is applied to closure flap B to securely fasten it to front panel F. At this stage in the assembly process, the blank B is placed into the hooper of a APV Anderson Model 755 Hot Melt Ice Cream Carton Filler or a compatable machine. (See attachment A-APV Anderson Model 755 brochure). The hopper (as in attachment A) is designed to hold 250 blanks oriented in such a manner that the cover, rear, bottom and front panels are vertically positioned. The individual blanks are removed from the hopper opened and squared by a vacuum pick-off. The blank A in the opened and squared position is best seen in FIG. 2. In this step, the membrane flaps 164, 166 and 184 are folded to lie in a plane substantially parallel with the cover panel C. Further, the front edges 176 of the front panel end flap membranes 164 and 166 are substantially aligned with the corresponding hinge lines 142 and 144. The significance of this arrangement will be more fully discussed below. The blank A in this partially erected stated is positioned to move through Model 755 such that the bottom panel is the leading panel. The Model 755 performs all folding steps to the bottom or left end flaps including the application of adhesive prior to filling. Specifically, referring to FIGS. 3 and 4, left or rear panel end flap 76 is folded inwardly first. Subsequently, the left or bottom panel end flap 138 is folded inwardly such that a portion thereof overlies rear panel end flap 76. The end flap membranes 164 and 166 stop short to top edges 84 of rear panel end flaps 76 and 78. This arrangement enhances both the seal of the carton and the assembly of the blank. With respect to the seal of the carton, this design obviates the need for a recess in top edges 84 of the rear panel end flaps 76 and 78 and thus provides a significantly tighter seal than achieved by previous cartons. With respect to the assembly process, by designing the end flap membranes 164 and 166 such that they stop short of top edges 84 of rear panel end flaps 76 and 78, there is no longer any possibility that the end flap membranes will become lodged against the rear panel end flaps 76 and 78 (FIG. 3). Thus, the blanks that are improperly folded and ultimately discarded are drastically reduced.

Adhesive strips 200 and 202 (FIG. 3) are applied to left front and rear panel end flaps 138 and 76. The specific manner in which the adhesive strips are applied is fully discussed in U.S. Pat. No. 4,555,027 and will not be further discussed hereinafter. Subsequently, the left cover panel end flap 42 is folded inwardly and pressure is applied thereto to secure end flap 42 to end flaps 138 and 76. Left bottom panel end flap 104 is folded inwardly and pressure is applied thereto securing end flap 104 to end flaps 138 and 76. Finally, glue or cover tab 10 is folded inwardly and secured to cover panel end flap 42. In this manner the bottom or left end of carton G is formed.

Figure 6:
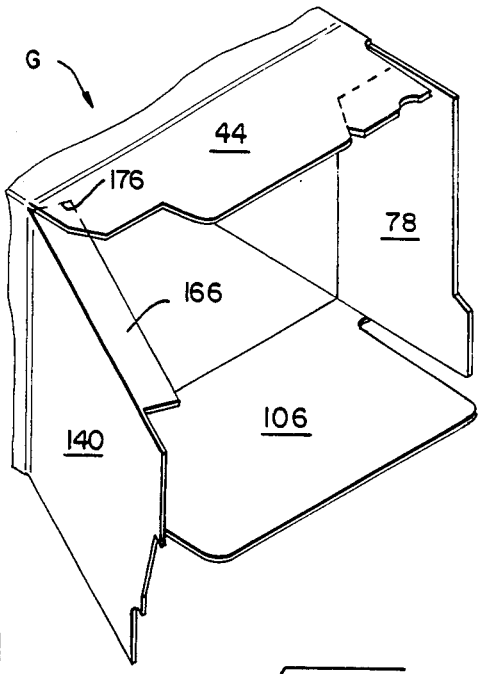
FIG. 6 is a fragmentary perspective view of the right end of the carton with the front panel end flap folded partially outward.
Figure 7:
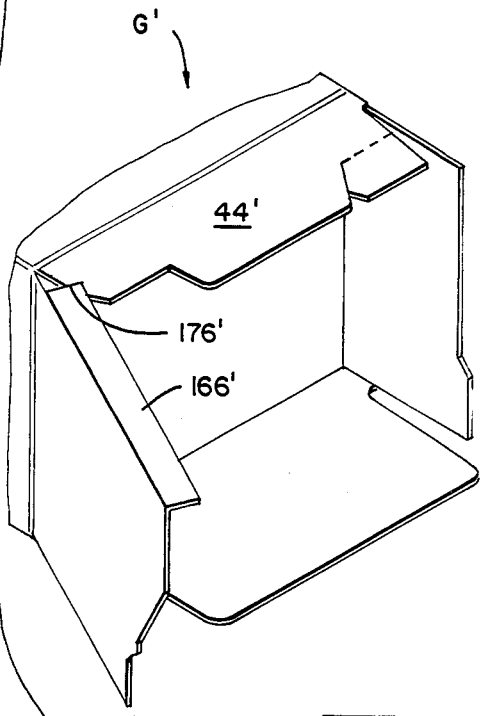
FIG 7 PRIOR ART
FIG. 7 illustrates a prior art carton blank in a view similar to FIG. 6.

The following folding steps are performed to prepare the right or top end of carton G for filling. The right bottom panel end flap 106 is folded outwardly such that it abutts or is directly adjacent bottom panel E. End flaps 140 and 78 are folded partially outward, and end flap 44 is folded to form substantially a right angle with cover panel C. Thus, an unobstructed throat is provided to permit the filler head (attachment A) to readily dispense ice cream or the like in a semi-solid state into the carton G. Once the carton G has been completely filled, the restraining devices holding the end flaps outward are removed and the sealing process of the right end begins. It is important to note that the position of the front edge 176 of the right front panel end flap membrane 166 is substantially aligned with hinge line 136 to prevent the cover panel end flap 44 from positioning itself inward of end flap membrane 166 and thus obstructing the sealing process G, as best seen in FIG. 6, of the right end of the carton. As is seen in FIG. 7, the prior art teaches the positioning of the front edge 176 of the end flap membrane 166 offset from hinge line 144. The prior art causes the cover panel end flap to position itself inward from the end flap membrane 166' and thus prevent sealing of the right end of the carton G'.This results in either the waste of the carton and its contents or a significant delay in the assembly process to enable the operator to correct the defect. In this invention, the right end flaps 44, 78, 106 and 140 are folded in the exact manner as the left end flaps to seal the end of the carton G.

The sealed carton G is illustrated in FIG. 8. The first portions 62, 120 and 124 of cover panel end flaps 42 and 44 and bottom panel end flaps 104 and 106 extend slightly beyond the corresponding corners of the carton G and extend parallel to the adjacent hinge lines. This feature of carton G significantly reduces the leakage of any contents contained therein from its corners.

CARTON OPENING

FIGS. 8, 9 AND 10

Figure 9:
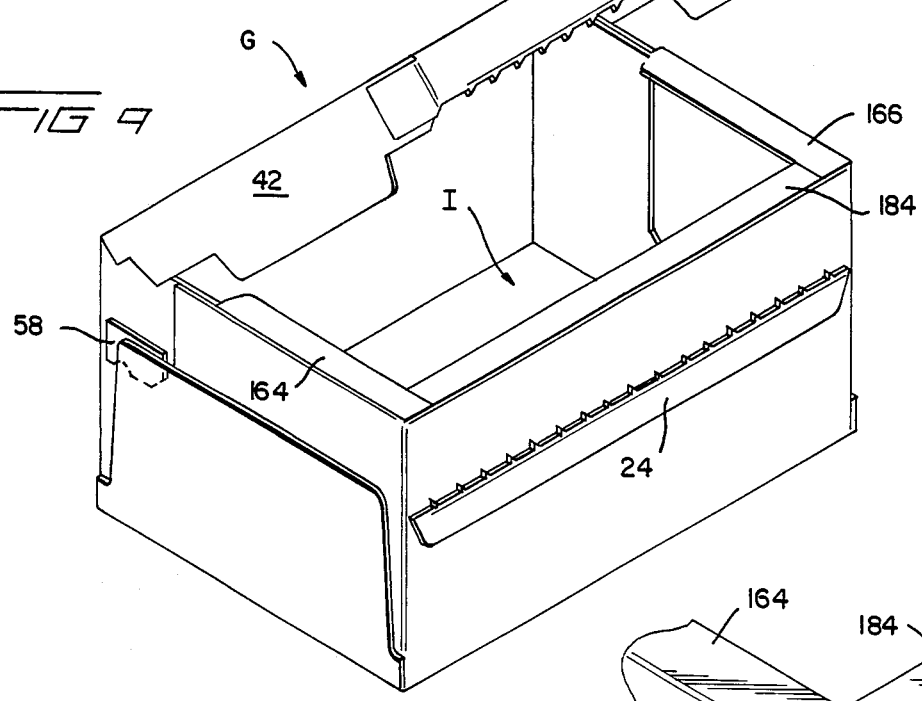
FIG. 9 is a perspective view of the carton with the tear strip removed.
Figure 10:
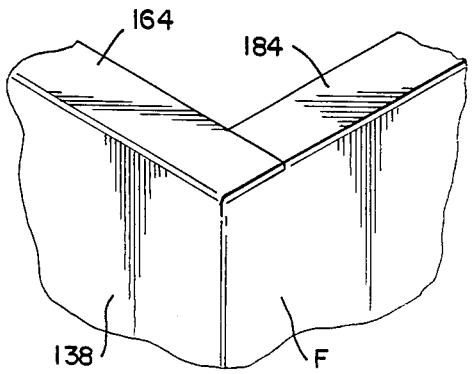
FIG. 10 is an exploded fragmentary perspective view of the left front end of the carton.

The steps necessary to gain access to the contents of the carton G will now be explained with reference to FIGS. 8, 9 and 10. To detach the cover panel C and the closure flap F, one need only pull on tear tab 31 and remove the tear strip 18 from front panel F, therefore, enabling a consumer to bend the cover panel C backward about hinge line 36 to gain access to the contents of the carton, as best seen in FIG. 9. The membrane flaps 164, 166 and 184 form a continous lip I about a portion of the outer periphery of the carton G. Lip I significantly enhances the seal of carton G. The radius 198 formed in each notch or recess 196 permits the end flap membranes 164 and 166 to rest directly on top edge 132 of front panel F as seen in FIG. 10. Also, the radius 198 provides additional stock material about the front corners of the carton G to further enhance the seal. To reseal the carton G, a consumer merely bends the cover panel C inwardly about hinge line 36 and inserts cover panel end flaps 42 and 44 between the corresponding front panel end flaps and bottom panel end flaps. A more detailed description of the resealing feature of the carton G is set out in U.S. Pat. No. 4,55,027.

The applicant's novel design of carton blank A has significantly improved the seal of cartons for packaging semi-liquids such as ice cream or the like. Further, unlike the previous carton design, this invention has improved the seal without compromising the adaptability of the carton blank to machine folding. Thus, applicant's carton blank design reduces unnecessary waste and delays in the assembly process attendant previous carton blanks.

While this invention has been described as having a preferred design, it is understood that it is capable of further modifications, uses and/or adaptations of the invention following in general the principle of the invention and including such departures from the present disclosure as come within the known or customary practice in the art to which the invention pertains, such as may be applied to the essential features set forth, and fall within the scope of the invention and of the limits of the appended claims.

What I claim is:

1. A blank for forming a carton for packaging ice cream and the like, comprising:

(a) connected cover, front, bottom, and rear panels;

(b) said cover and bottom panels each having front, rear, left and right edges;

(c) said front and rear panels each having top, bottom, left and right edges;

(d) a closure flap hingedly connected to said front edge of said cover panel;

(e) said rear panel being hingedly connected at its top edge to said rear edge of said cover panel;

(f) said bottom panel being hingedly connected at its rear edge to said bottom edge of said rear panel;
(g) said front panel being hingedly connected at its bottom edge to said front edge of said bottom panel;
(h) said panels each having left and right end flaps connected to said left and right edges respectively forming hinge lines therebetween;
(i) said left end flaps having dimensions such that upon folding of said left end flaps inwardly, to form the left end of the carton, the left end is substantially sealed for preventing leakage therefrom;
(j) said right end flaps having dimensions such that upon folding of said right end flaps inward, to form the right end of the carton, the right end is substantially sealed for preventing leakage therefrom;
(k) a membrane flap extending from the top edge of said front panel;
(l) said end flaps each having top, bottom, front and rear edges;
(m) said left and right front panel end flaps each having a membrane flap extending from said top edges in a direction substantially similar to the direction said front panel membrane extends in the non-erected position;
(n) said left and right front panel end flap membranes each having front, rear, inner and outer edges;
(o) said front panel membrane having rear, front, left side and right side edges;
(p) said left and right front panel end flap membranes and said front panel membrane, when said blank is erected, forming a substantially continuous lip extending inwardly and along at least a portion of an outer periphery of the carton;
(q) at leat one of said front panel end flap membranes, in the non-erected position, having a front edge extending substantially parallel and substantially aligned with its respective hinge line formed intermediate said left and right front panel end flaps and said front panel;
(r) said front panel membrane having its side edge, adjacent said at least one of said front panel end flaps, spaced therefrom forming a notch therebetween; and,
(s) said notch extending along said hinge line formed between said front panel membrane and said front panel a distance substantially equal to the length of said front edge of said at least one of said front panel end flap membranes.

2. A blank as in claim 1, wherein:
(a) said notch is substantially rectangular in shape.

3. A blank as in claim 1, wherein:
(a) said front edges of said left and right front panel end flap membranes, in the non-erected position, extend substantially parallel and substantially aligned with their respective hinge lines formed intermediate said left and right front panel end flaps and said front panel;
(b) said left and right sides of said front panel membrane are spaced from the corresponding front edges of said left and right front panel end flaps forming a notch therebetween; and,
(c) said notches each extend along said hinge line formed between said front panel membrane and said front panel a distance substantially equal to the length of the corresponding front edges of said left and right front panel end flap membranes.

4. A blank as in claim 3, wherein:
(a) said notches are substantially rectangular in shape.

5. A blank as in claim 4, wherein:
(a) said closure flap includes top, bottom left and right edges; and,
(b) said left and right edges of said closure flap each have a cover tab hingedly connected thereto.

6. A blank as in claim 5, wherein:
(a) said closure flap includes at least one weakness line formed therein for permitting detachment of the cover panel from the front panel when the blank is fully erected.

7. A blank as in claim 1, wherein:
(a) said front and rear edges of said left and right bottom panel end flaps each include a first portion that extends in the non-erected position substantially parallel to a hinge line formed between said bottom and rear panels; and,
(b) said first portions, in the non-erected position, overlap the corresponding bottom edges of said left and right front panel end flaps and said left and right rear panel end flaps for preventing leakage of ice cream or the like from the corners of the carton when said blank is fully erected.

8. A blank as in claim 1, wherein:
(a) said front and rear edges of said left and right bottom panel end flaps include a first portion that extends in the non-erected position substantially parallel to the hinge line formed between said bottom and rear panels; and,
(b) said first portions, in the non-erected position, overlap the corresponding bottome edges of said left and right front panel end flaps and said left and right rear panel end flaps for preventing leakage of ice cream or the like from the corners of the carton when the blank is fully erected.

9. A carton for packaging ice cream or the like, comprising:
(a) connected cover, front, bottom, and rear panels;
(b) said cover and bottom panels each having front, rear, left and right edges;
(c) said front and rear panels each having top, bottom, left and right edges;
(d) a closure flap hingedly connected to said front edge of said cover panel;
(e) said rear penel being hingedly connected at its top edge to said rear edge of said cover panel;
(f) said bottom panel being hingedly connected at its rear edge to said bottom edge of said rear panel;
(g) said front panel being hingedly connected at its bottom edge to said front edge of said bottom panel;
(h) said panels each having left and right end flaps connected to said left and right edges respectively forming hinge lines therebetween;
(i) said left end flaps having dimensions such that upon folding of said left end flaps inwardly, to form the left end of the carton, the left end is substantially sealed for preventing leakage therefrom;
(j) said right end flaps having dimensions such that upon folding of said right end flaps inward, to form the right end of the carton, the right end is substantially sealed for preventing leakage therefrom;
(k) a membrane flap extending from the top edge of said front panel;
(l) said end flaps each having top, bottom, front and rear edges;
(m) said left and right front panel end flaps each having a membrane flap extending from said top edges in a direction substantially similar to the direction said front panel membrane extends in the non-erected position;

(n) said left and right front panel end flap membranes each having front, rear, inner and outer edges;

(o) said front panel membrane having rear, front, left side and right side edges;

(p) said left and right front panel end flap membranes and said front panel membrane, when said blank is erected, forming a substantially continuous lip extending inwardly and along at least a portion of an outer periphery of the carton;

(q) at least one of said front panel end flap membranes having a front edge extending, in the erected position, substantially parallel to said front panel and being positioned forward of said rear edge of said front panel membrane;

(r) said front panel membrane having its side edge, adjacent said at least one of said front panel end flaps, spaced therefrom forming a notch therebetween;

(s) said notch extending along said hinge line formed between said front panel membrane and said front panel a distance substantially equal to the length of said front edge of said at least one of said front panel end flap membranes;

(t) said closure flap having at least one weakness line formed therein for permitting detachment of the cover panel from the front panel when said carton is fully erected;

(u) means for securing said closure flap to said cover panel;

(v) means for securing said left end flaps in a fully erected position for forming a substantially sealed carton end; and (w) means for securing said right end flaps in a fully errected position for forming a substantially sealed carton end.

10. A carton as in claim 9, wherein:

(a) said notch is substantially rectangular in shape.

11. A carton as in claim 9, wherein:

(a) said front edges of said left and right front panel end flap membranes extend, in the erected position, substantially parallel to said front panel and being positioned forward of said rear edge of said front panel membrane;

(b) said left and right sides of said front panel membrane are spaced from the corresponding left and right front panel end flaps forming notches therebetween and, (c) said notches each extend along said hinge line formed between said front panel membrane and said front panel a distance substantially equal to the length of the corresponding front edges of said left and right front panel end flap membranes.

12. A carton as in claim 11, wherein:

(a) said notches are substantially rectangular in shape.

13. A carton as in claim 12, wherein:

(a) said front and rear edges of said left and right bottom panel end flaps include a first portion that extends in the erected position substantially perpendicular to said cover panel and extends outwardly from the corresponding corner of said carton formed by the hinge lines intermediate said front panel and said left and right front panel end flaps and said rear panel and said left and right rear panel end flaps.

14. A blank for forming a carton for packaging ice cream or the like comprising:

(a) connected cover, front, bottom and rear panels;

(b) said cover and bottom panels each having front, rear, left and right edges;

(c) said front and rear panels each having top, bottom, left and right edges;

(d) a closure flap hingedly connected to said front edge of said cover panel;

(e) said rear panel being hingedly connected at its top edge to said rear edge of said cover panel;

(f) said bottom panel being hingedly connected at its rear edge to said bottom edge of said rear panel;

(g) said front panel being hingedly connected at its bottom edge of said front edge of said bottom panel;

(h) said panels each having left and right end flaps connected to said left and right edges respectively forming hinge lines therebetween;

(i) said left end flaps having dimensions such that upon folding of said left end flaps inwardly, to form the left end of the carton, the left end is substantially sealed for preventing leakage therefrom;

(j) said end flaps having dimensions such that upon folding of said right end flaps inward, to form the right end of the carton, the right end is substantially sealed for preventing leakage thereform;

(k) a membrane flap extending from the top edge of said front panel;

(l) said left and right front panel end flaps each having an upper portion including top front and rear edges;

(m) said left and right front panel end flaps each having a membrane flap extending from said respective top edges in a direction substantially similar to the direction said front panel membrane extends in the non-erected position;

(n) said left and right front panel end flap membranes each having front, rear, inner and outer edges;

(o) said front panel membrane having rear, front, left side and right side edges;

(p) said left and right front panel end flap membranes and said front panel membrane, when said blank is erected, forming a substantially continuous lip extending inwardly and along at least a portion of an outer periphery of the carton;

(q) at least one of said left panel end flap membrane, right panel end flap membrane and said front panel membrane having a notch formed therein adjacent one of said hinge lines intermediate said left and right front panel end flaps and said front panel;

(r) said left and right rear panel end flaps each having top and bottom edges;

(s) said top edges extending, in the non-erected position, substantially parallel and substantially aligned with said hinge line formed intermediate said cover panel and said rear panel;

(t) at least one of said top edges of said left and right rear panel end flaps overlies it corresponding front panel end flap when said blank is erected;

(u) said rear edge of said front panel end flap membrane, corresponding to said rear panel end flap having said overlapping top edge, being positioned inwardly from the rear edge of the upper portion of their respective front panel end flaps a distance substantially equal to the distance said at least one overlapping top edge overlaps its corresponding from panel end flap for permitting easy assembly of the blank.

15. A blank as in claim 14, wherein:

(a) said rear edge of said front panel end flap membrane corresponding to said rear panel end flap having said overlapping top edge includes first and second portions;

(b) said first portion extends substantially perpendicular to said top edge of said front panel end flap; and, (c) said second portion forms an angle with said first portion of less than 180° for permitting easy assembly of the blank.

16. A blank as in claim 15, wherein:

(a) said closure flap includes top, bottom, left and right edges; and, (b) said left and right edges of said closure flap each have a cover tab hingedly connected thereto.

17. A carton for packaging ice cream or the like, comprising:

(a) connected cover, front, bottom, and rear panels;

(b) said cover and bottom panels each having front, rear, left and right edges;

(c) said front and rear panels each having top, bottom, left and right edges;

(d) a closure flap hingedly connected to said front edge of said cover panel;

(e) said rear panel being hingedly connected at its top edge to said rear edge of said cover panel;

(f) said bottom being hingedly connected at its rear edge to said bottom edge of said rear panel;

(g) said front panel being hingedly connected at its bottom edge to said front edge of said bottom panel;

(h) said panels each having left and right end flaps connected to said left and right edges respectively forming hinge lines therebetween;

(i) said left end flaps having dimensions such that upon folding of said left end flaps inwardly, to form the left end of the carton, the left end is substantially sealed for preventing leakage therefrom;

(j) said right end flaps having dimensions such that upon folding of said right end flaps inward, to form the right end of the carton, the right end is substantially sealed for preventing leakage therefrom;

(k) a membrane flap extending from the top edge of said front panel;

(l) said left and right front panel end flaps each having an upper portion including top, front and rear edges;

(m) said left and right front panel end flaps each having a membrane flap extending from said top edges;

(n) said left and right front panel end flap membranes each having front rear, inner and outer edges;

(o) said front panel membrane having rear, front, left and right side edges;

(p) said left and right front panel end flap membranes and said front panel membrane forming a substantially continuous lip extending inwardly and along at least a portion of an outer periphery of said carton;

(q) at least one of said left panel end flap membrane, right panel end flap membrane and said front panel membrane having a notch formed therein adjacent one of said hinge lines intermediate said left and right front panel end flaps and said front panel in the non-erected position;

(r) said left and right rear panel end flaps each having top and bottom edges;

(s) at least one of said top edges of said left and right rear panel end flaps overlaps it corresponding front panel end flap;

(t) said rear edge of said front panel end flap membrane, corresponding to said rear panel end flap having said overlapping top edge, being positioned inwardly from the rear edge of said upper portion of the corresponding front panel end flap at least a distance substantially equal to the distance said at least one overlapping top edge. overlaps its corresponding front panel end flap for permitting easy assembly of the blank;

(u) said closure flap having at least one weakness line formed therein for permitting detachment of the cover panel from the front panel when said carton is fully erected;

(v) means for securing said closure flap to said cover panel;

(w) means for securing said left end flaps in a fully erected position for forming a substantially sealed carton end; and (x) means for securing said right end flaps in a fully erected position for forming a substantially sealed carton end.

18. A carton as in claim 17, wherein:

(a) said front edges of said left and right bottom panel end flaps include a first portion that extends, in the erected position, substantially perpendicular to said cover panel and outwardly from the corresponding corner of said carton formed by the hinge lines intermediate said front panel and said left and right front panel end flaps and said rear panel and said left and right rear panel end flaps.

19. A carton as in claim 18, wherein:

(a) said rear edges of said left and right cover panel end flaps include a first portion that extends, in the erected position, substantially perpendicular to said cover panel and outwardly from the corresponding corner of said carton formed by the hinge lines intermediate said rear panel and said left and right rear panel end flaps.

20. A carton as in claim 17, wherein:

(a) said rear edge of said front panel end flap membrane corresponding to said rear panel end flap having said overlapping top edge includes first and second portions;

(b) said first portion extends substantially perpendicular to said top edge of said front panel end flap; and, (c) said second portion forming an angle with said first portion of less than 180° for permitting easy assembly of the blank.

21. A blank for forming a carton for packaging ice cream or the like, comprising:

(a) connected cover, front, bottom, and rear panels;

(b) said cover and bottom panels each having front, rear, left and right edges;

(c) said front and rear panels each having top, bottom, left and right edges;

(d) a closure flap hingedly connected to said front edge of said cover panel;

(e) said rear panel being hingedly connected at its top edge to said rear edge of said cover panel;

(f) said bottom panel being hingedly connected at its rear edge to said bottom edge of said rear panel;

(g) said front panel being hingedly connected at its bottom edge to said front edge of said bottom panel;

(h) said panels each having left and right end flaps connected to said left and right edges respectively forming hinge lines therebetween;

(i) said left end flaps having dimensions such that upon folding of said left end flaps inwardly, to form the left end of the carton, the left end is substantially sealed for preventing leakage therefrom;

(j) said right end flaps having dimensions such that upon folding of said right end flaps inwardly, to form the right end of the carton, the right end is substantially sealed for preventing leakage therefrom;

(k) a membrane flap extending from the top edge of said front panel;

(l) said end flaps each having top, bottom, front and rear edges;

(m) said left and right front panel end flaps each having a membrane flap extending from said top edges, in a direction substantially similar to the direction said front panel membrane extends in the non-erected position, and forming therebetween first and second hinge lines respectively;

(n) said left and right front panel end flap membranes each having front, rear, inner and outer edges;

(o) said front panel membrane having rear, front, left and right side edges;

(p) said left and right front panel end flap membranes and said front panel membrane, when said blank is erected, forming a substantially continuous lip extending inwardly and along at least a portion of an outer periphery of the carton;

(q) at least one of said left panel end flap membrane, right panel end flap membrane and said front panel membrane having a notch formed therein adjacent one of said hinge lines intermediate said left and right front panel end flaps and said front panel;

(r) one of said first and second hinge lines adjacent said notch intersects the corresponding hinge line formed intermediate said left and right end flaps and said front panel; and, (s) a radius formed in said notch adjacent said intersection for preventing leakage of the corner of the carton formed at said intersection.

22. A blank as in claim 21, wherein:

(a) said front panel membrane having a notch formed therein adjacent the hinge line intermediate said left panel end flap and said front panel.

23. A blank as in claim 22, wherein:

(a) said notch is substantially rectangular in shape.

24. A blank as in claim 21, wherein:

(a) said front and rear edges of said left and right bottom panel end flaps include a first portion that extends in the non-erected position substantially parallel to the hinge line formed between said bottom and rear panels; and, (b) said first portions, in the non-erected position, overlap the corresponding bottom edges of said left and right front panel end flaps and said left and right rear panel end flaps for preventing leakage of ice cream or the like from the corners of the carton when said blank is fully erected.

25. A carton for packaging ice cream of the like, comprising:

(a) connected cover, front, bottom and rear panels;

(b) said cover and bottom panels each having front, rear, left and right edges;

(c) said front and rear panels each having top, bottom, left and right edges;

(d) a closure flap hingedly connected to said front edge of said cover panel;

(e) said rear panel being hingedly connected at its top edge of said rear edge of said cover panel;

(f) said bottom panel being hingedly connected at its rear edge to said bottom edge of said rear panel;

(g) said front panel being hingedly connected at its bottom edge to said front edge of said bottom panel;

(h) said panels each having left and right end flaps connected to said left and right edges respectively forming hinge lines therebetween;

(i) said left end flaps having dimensions such that upon folding of said left end flaps inwardly, to form the left end of the carton, the left end is substantially sealed for preventing leakage therefrom;

(j) said right end flaps having dimensions such that upon folding of said right end flaps inwardly, to form the right end of the carton, the right end is substantially sealed for preventing leakage therefrom;

(k) a membrane flap extending from the top edge of said front panel;

(l) said end flaps each having top, bottom, front and rear edges;

(m) said left and right front panel end flaps each having a membrane flap extending inwardly from said top edges forming therebetween first and second hinge lines respectively;

(n) said left and right front panel end flap membranes each having front, rear, inner and outer edges;

(o) said front panel membrane having rear, front, left side and right side edges;

(p) said left and right front panel end flap membranes and said front panel membrane, when said blank is erected, forming a substantially continuous lip extending inwardly and along at least a portion of an outer periphery of the carton;

(q) at least one of said left panel end flap membrane, right panel end flap membrane and said front panel membrane having a notch formed therein adjacent one of said hinge lines intermediate said left and right front panels;

(r) said notch having a configuration for accommodating an adjacent membrane;

(s) one of said first and second hinge lines adjacent said notch intersecting the corresponding hinge line formed intermediate said left and right end flaps and said front panel;

(t) a radius formed in said notch adjacent said intersection for preventing leakage of the carton formed at said intersection;

(u) said closure flap having at least one weakness line formed therein for permitting detachment of the cover panel from the front panel when said carton is fully erected;

(v) means for securing said closure flap to said cover panel;

(w) means for securing said left end flaps in a fully erected position for forming a substantially sealed carton end; and (x) means for securing said right end flaps in a fully erected position for forming a substantially sealed carton end.

26. A carton as in claim 25, wherein:

(a) said front panel membrane having a notch formed therein adjacent the hinge line intermediate said left panel end flap and said front panel.

27. A carton as in claim 26, wherein:

(a) said notch is substantially rectangular in shape.

28. A carton as in claim 25, wherein:

(a) said front and rear edges of said left and right bottom panel end flaps include a first portion that extends in the erected position, substantially perpendicular to said cover panel and extends outwardly from the corresponding corner of said carton formed by the hinge lines intermediate said front panel and said left and right front panel end flaps and said rear panel and said left and right rear panel end flaps.

* * * * *